US005405238A

United States Patent [19]

Samsel, Jr.

[11] Patent Number: 5,405,238

[45] Date of Patent: Apr. 11, 1995

[54] THREE POINT LOG SKIDDER

[76] Inventor: William K. Samsel, Jr., 16 Coriacan La., Missoula, Mont. 59802

[21] Appl. No.: 47,945

[22] Filed: Apr. 16, 1993

[51] Int. Cl.[6] ..... B66D 3/00

[52] U.S. Cl. ..... 414/703; 294/111; 294/118; 414/734; 414/739

[58] Field of Search ..... 414/703, 729, 734, 739; 212/259, 265; 294/118, 111, 112, 81.61, 86.41; 37/302

[56] References Cited

U.S. PATENT DOCUMENTS

| | | | |
|---|---|---|---|
| 435,835 | 9/1890 | Hunter | 294/112 X |
| 2,893,778 | 7/1959 | Eckstein | 414/734 |
| 3,860,282 | 1/1975 | Johnson | 414/739 |
| 5,061,150 | 10/1991 | Rentschler | 37/302 |

FOREIGN PATENT DOCUMENTS

| | | | |
|---|---|---|---|
| 624460 | 6/1949 | United Kingdom | 414/703 |

*Primary Examiner*—Donald W. Underwood
*Attorney, Agent, or Firm*—Harry M. Cross, Jr.

[57] ABSTRACT

The present invention provides a grapple tongs device for mounting to the three-point hitch of the type found on agricultural tractors. The apparatus of this invention comprises a three-point hitch mounting, a grapple boom extending from the hitch mounting, a grapple tongs device suspended from the outer end of the grapple boom, and means for orienting the grapple tongs. The means for orienting the grapple tongs preferably also is employed to open the grapple tongs, the tongs preferably being of the gravity-closing type.

4 Claims, 1 Drawing Sheet

THREE POINT LOG SKIDDER

FIELD OF THE INVENTION

This invention relates to logging equipment and, more particularly to log grapple apparatus designed to be mounted to the three-point hitch of the type installed on agricultural-type tractors.

BACKGROUND OF THE INVENTION

Ranchers and farmers oftentimes need to engage in small-scale logging operations, but are hindered by a lack of suitable equipment. Logging equipment suited for larger scale operations is too expensive. Smaller scale equipment has been proposed but has either not been found suitable in many conditions, or has been too complicated and expensive.

Although three-point hitch, tractor-mounted logging equipment has been proposed heretofore, the nature of three-point hitch mountings has limited the utility of the equipment. Unless complicated, and usually expensive, means are employed to permit the log-engaging device to be oriented (i.e., for example, "swiveled") to permit attaching to logs that are askew to the longitudinal axis of the tractor, the tractor must be brought into a roughly-axial alignment with the log before it can be grappled. This limits the use of the logging equipment to terrain that is open enough and sufficiently obstacle-free that the tractor can be maneuvered into alignment with the logs to be grappled.

SUMMARY OF THE INVENTION

The present invention provides a grapple tongs device for mounting to the three-point hitch of the type found on agricultural tractors. The apparatus of this invention comprises a three-point hitch mounting, a grapple boom extending from the hitch mounting, a grapple tongs device suspended from the outer end of the grapple boom, and means for orienting the grapple tongs. The means for orienting the grapple tongs preferably also is employed to open the grapple tongs, the tongs preferably being of the gravity-closing type.

Because the grapple tongs can be oriented around a generally-vertical axis that is perpendicular to the grapple boom, the grapple tongs can be applied to a felled log that is aligned askew to the tractor. Consequently, the logs can be grappled from terrain and around obstacles that might otherwise be unreachable.

DETAILED DESCRIPTION OF THE INVENTION

Figure 1:
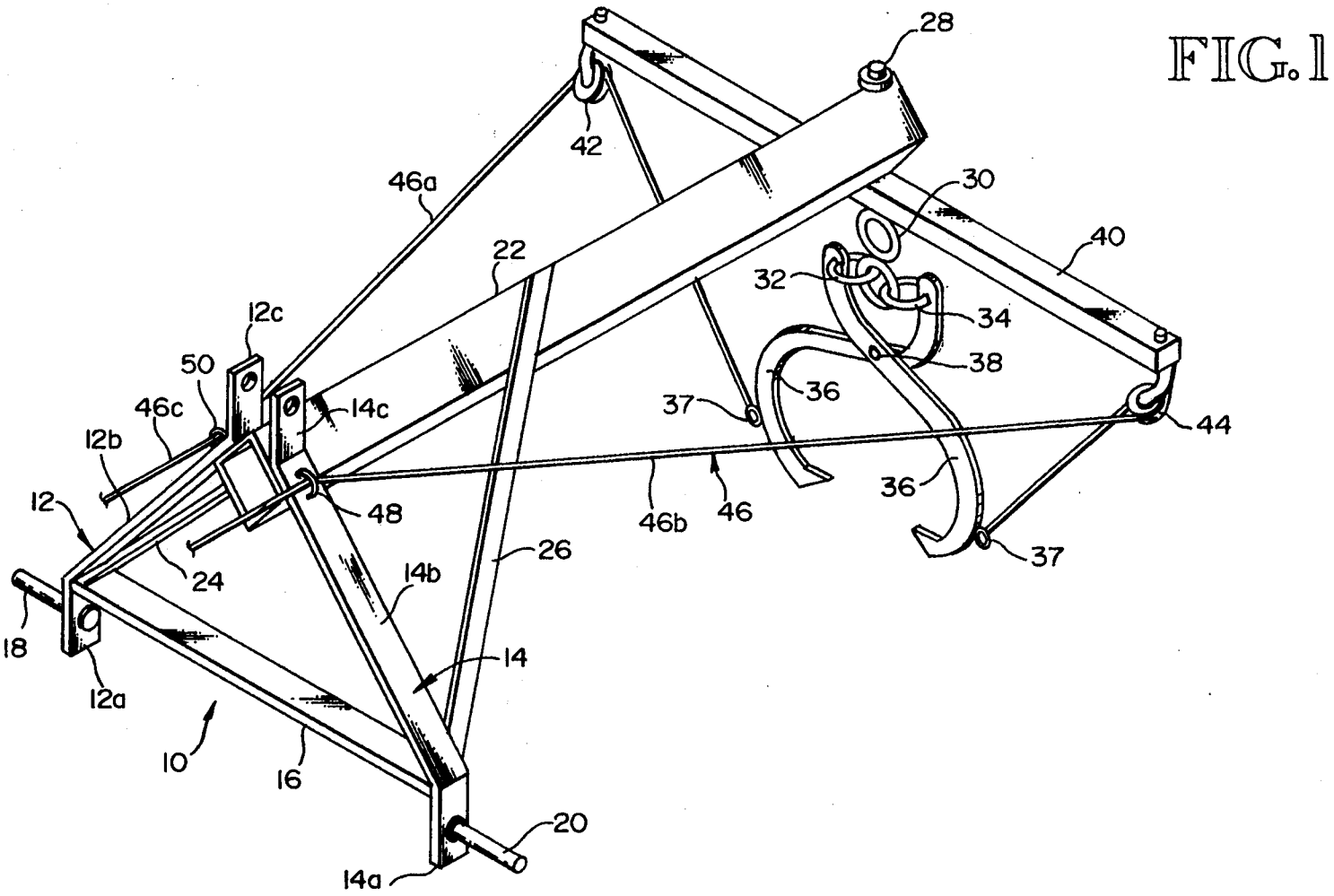
FIG. 1 is a perspective view of the three-point hitch mountable skidder apparatus of this invention.

The skidder of this invention is designed to be mounted to and carried by a three-point hitch of the type found on agricultural tractors. For these tractors, the tractor transmission has a shaft extending out sideways from each side of the rear portion of the transmission case. These two shafts rotate together, and are controlled by the tractor operator through a hydraulic system using a singly control handle. A draft bar is attached to each of the shafts and extend rearward to a point in back of the tractor's rear wheels. The free end of each draft bar has a cylindrical horizontal hole for the attachment of an agricultural implement. Sometimes the free end of the draft bar is fitted with a ball-and -socket joint, having a cylindrical attachment hole in the ball. The third point of the three-point hitch is a rod of adjustable length which is rotatably attached to the tractor at a point above the draft bars, and well forward of the attachment points. When the operator decides to move from one field to another, or simply to cease using the implement and move the tractor, he utilizes the hydraulic system to rotate the draft bars upward and thereby raise the implement above the ground. It is this type of three-point hitch that the log skidder for which this invention is specifically designed. However, any similar type hitch where three attachment points are provided is intended to be included in the term "three-point hitch" as this term is hereinafter used.

The three-point hitch mounting 10 comprises left and right steel bars 12, 14 that are bent to provide a downwardly-extending lower vertical leg 12*a*, 14*a*, an inwardly-angled mid-portion 12*b*, 14*b*, and an upwardly-extending upper vertical leg 12*c*, 14*c*. A steel bar reinforcing brace 16 extends between the bars 12, 14 and is welded thereto at the breakpoint between the lower legs 12*a*, 14*a*, and the mid-portions 12*b*, 14*b* as shown. The lower legs mounts outwardly-extending steel pins 18, 20, respectively, which are of a size to fit within the horizontal holes at the free ends of the tractor hitch draft bars. The upper legs 12*c*, 14*c* are provided with aligned horizontal holes for attachment, by means of a draft pin, to the tractor hitch rod. The mid-portions 12*b*, 14*b* of the bars 12, 14 are preferably oriented at 45° .

A grapple boom 22 is provided in the form of a square cross-sectioned steel beam. At one end, beam 22 is welded to the steel bars 12, 14 at the upper end of the mid-portions 12*c*, 14*c* as shown. Left and right boom reinforcing steel bars 24, 26 are extended between the hitch mounting reinforcing bar 16 and the mid-portion of the boom 22 and welded thereto. The ends of the bars 24, 26 are welded in place near the ends of bar 16.

The outer, free end of the grapple boom 22 is provided with a vertical bore through which a grapple-mounting bolt 28, or the like, is mounted. A swivel 30 is mounted to the lower end of bolt 28, and itself mounts shackles 32, 34. A pair of gravity-tongs 36—36 are joined pivotally in crossed relationship by a pivot bolt 38 and are swivelly suspended by the shackles 32, 34 to the boom swivel 30. The grapple tongs 36—36 are provided with grapple teeth as shown at their lower ends. On the lower, outer portions of the tongs, each tong is provided with a cord attachment ring 37—37.

A spreader bar 40 is swivelly mounted by the bolt 28, between the underside of the boom 22 and the swivel 30. Each end of the spreader bar 40 pivotally mounts a pulley 42, 44. A tongs-opening and orienting cord 46 is attached at each end to a tong ring 37. The cord 46 extends from one ring 37, through an adjacent pulley 42, forwardly through a cord guide 48 on bar 14, around through cord guide 50 on bar 12, rearwardly through pulley 44, and down to the adjacent ring 37. The cord 46 is long enough to provide a loop 46*c* of extra length to enable the tractor operator to grab the cord and pull it one way or the other. If the operator pulls the cord straight toward himself, the gravity tongs will be lifted to an open position as is shown in the Figure. If the operator pulls on the left reach 46*a* or the right reach 46*b* of the cord 46, the spreader bar 40 will be swung to the left or to the right, Because of the role of cord 46 in linking the grapple tongs 36—36 with the spreader bar 40, movement of the spreader bar 40 will cause the grapple tongs 36—36 to be swung to the left or to the right, respectively, also.

If desired a pair of simple coil springs could be attached to the grapple boom 22 and to the spreader bar 40 to enable the spreader bar 40 and grapple tongs 36—36 to be automatically aligned crosswise to the longitudinal axis of the grapple boom 22. In this embodiment, the springs could be attached anywhere on the spreader bar, such as at its end adjacent the pulleys 42, 44 and to a point on the boom 22 forwardly of the location of bolt 28.

In operation, an operator would back the tractor to a position where the grapple tongs 36—36 overlay a felled log. The operator would pull on the cord 46 to align the spreader bar 40 and the grapple tongs 36—36 whereby the grapple tongs would be transverse to the longitudinal axis of the log. The operator would then pull on cord 46 to open the grapple tongs and then lower the grapple boom 22 to place the grapple tongs around the log. The operator would then release the cord 46, letting the tongs close by gravity around the log, and raise the grapple boom to lift the grappled-end of the log clear of the ground. Then the log could be skidded away. (The operator raises and lowers the free end of the grapple boom 22 by operating the hydraulic control for the tractor's three point hitch.) When the skidded log is to be released, the operator lowers the grapple boom to lower the grappled-end of the log back to the ground, pulls on cord 46 to open the tongs, raises the grapple boom to lift the grapple tongs clear of the log, and then releases the cord to let the tongs close by gravity.

If desired, the cord 46 could be reeved on one or more hudraulic cable reels or drums so that the operator could effect a pulling on one cord reach and the paying out of the other, or effect a pulling or releasing of both reaches simultaneously, by manipulating appropriate hydraulic controls. Alternately, a lever mechanism could be installed that would permit the pulling on one cord reach or the other by shifting a lever to the right or to the left, and that would permit the pulling or releasing of both reaches by shifting a lever forwardly or rearwardly.

While the preferred embodiment of the invention has been described herein, variations in the design may be made. The scope of the invention, therefore, is only to be limited by the claims appended hereto.

The embodiments of the invention in which an exclusive property is claimed are defined as follows:

1. A three-point hitch mountable log skidder apparatus which comprises a three-point hitch mounting means; a grapple boom extending from the hitch mounting means and having an outer end; a grapple tongs device comprising a pair of grapple tongs suspended from the outer end of the grapple boom; and means for orienting the grapple tongs relative to the grapple boom; said means for orienting the grapple tongs comprising a spreader bar means swivelly mounted to said outer end of the grapple boom, and cord means secured to the grapple tongs device and extended through opposite ends of the spreader bar means so as to provide left and right reaches whereby an operator may draw on one cord reach or the other to cause the spreader bar means to swivel relative to the grapple boom and thereby effect a swivelling adjustment of the position of the grapple tongs.

2. The apparatus according to claim 1 wherein the grapple tongs device comprises gravity-closing tongs; and wherein said cord means is secured to each the grapple tongs so that the grapple tongs may be opened as well as oriented around a generally-vertical axis that is perpendicular to the grapple boom by pulling on said cord means, whereby the grapple tongs can be applied to a felled log that is aligned askew to the grapple boom.

3. A three-point hitch mountable log skidder apparatus which comprises a three-point hitch mounting means; a grapple boom extending from the hitch mounting means and having an outer end; a grapple tongs device comprising a pair of grapple tongs suspended from the outer end of the grapple boom; and means for orienting the grapple tongs relative to the grapple boom; said means for orienting the grapple tongs comprising spreader bar means, swivel means mounting the grapple tongs to said outer end of the grapple boom and also mounting the spreader bar means to said outer end of the grapple boom, and cord means secured to the grapple tongs and extended through opposite ends of the spreader bar means so as to provide a loop having left and right reaches whereby an operator may pull on one cord reach or the other to cause the spreader bar means to swivel relative to the grapple boom and thereby effect a swivelling adjustment of the position of the grapple tongs.

4. A three-point hitch mountable log skidder apparatus which comprises a three-point hitch mounting means; a grapple boom extending from the hitch mounting means and having an outer end; a grapple tongs device suspended from the outer end of the grapple boom; and means for orienting the grapple tongs relative to the grapple boom; said grapple tongs device comprising gravity-closing tongs; said means for orienting the grapple tongs being so connected to the grapple tongs that the grapple tongs may be opened as well as oriented around a generally-vertical axis that is perpendicular to the grapple boom, whereby the grapple tongs can be applied to a felled log that is aligned askew to the grapple boom; and said means for orienting the grapple tongs comprising means mounting the grapple tongs to said outer end of the grapple boom, a spreader bar means swivelly mounted to said outer end of the grapple boom, and cord means secured to each of the grapple tongs and extended through opposite ends of the spreader bar means so as to provide a loop having left and right reaches whereby an operator may pull on one cord reach or the other to cause the spreader bar means to swivel relative to the grapple boom and thereby effect a swivelling adjustment of the position of the grapple tongs.

* * * * *